US009741299B2

(12) United States Patent
Lee et al.

(10) Patent No.: US 9,741,299 B2
(45) Date of Patent: Aug. 22, 2017

(54) DISPLAY PANEL INCLUDING A PLURALITY OF SUB-PIXEL

(71) Applicant: LG DISPLAY CO., LTD., Seoul (KR)

(72) Inventors: Byung Hyun Lee, Paju-si (KR); Dong Su Shin, Yangpyeong-Gun (KR); Chi Youl Lee, Chilgok-Gun (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/955,883

(22) Filed: Dec. 1, 2015

(65) Prior Publication Data

US 2016/0155401 A1 Jun. 2, 2016

(30) Foreign Application Priority Data

Dec. 1, 2014 (KR) ..... 10-2014-0169888

(51) Int. Cl.
*G09G 3/36* (2006.01)
*G09G 5/02* (2006.01)
*G09G 3/20* (2006.01)

(52) U.S. Cl.
CPC ..... *G09G 3/3614* (2013.01); *G09G 3/3607* (2013.01); *G09G 3/3648* (2013.01); *G09G 3/2074* (2013.01); *G09G 2300/0426* (2013.01); *G09G 2300/0452* (2013.01); *G09G 2330/021* (2013.01)

(58) Field of Classification Search
CPC .. G09G 3/3614; G09G 3/2074; G09G 3/3607; G09G 3/3648
USPC ..... 345/96, 695
See application file for complete search history.

(56) References Cited

U.S. PATENT DOCUMENTS

2005/0068281 A1* 3/2005 Shin ..... G02F 1/134336 345/88
2006/0202927 A1* 9/2006 Lee ..... G09G 3/3614 345/88
2007/0268433 A1* 11/2007 Moon ..... G02F 1/133555 349/114
2008/0088754 A1* 4/2008 Hu ..... G02F 1/133555 349/33
2011/0148743 A1* 6/2011 Kuo ..... G09G 3/3607 345/55
2011/0156992 A1* 6/2011 Moon ..... G09G 3/3614 345/84

* cited by examiner

*Primary Examiner* — Adam J Snyder
(74) *Attorney, Agent, or Firm* — Birch, Stewart, Kolasch & Birch, LLP

(57) ABSTRACT

A display panel according to an embodiment includes a plurality of gate lines and a plurality of data lines disposed to cross each other and define a plurality of sub-pixel regions; and a plurality of sub-pixels disposed in the plurality of sub-pixel regions and configured to share one of the data lines adjacent thereto. The sub-pixels sharing the same data line are arranged in a shape of zigzagging along a vertical direction by four sub-pixels.

16 Claims, 10 Drawing Sheets

DISPLAY PANEL INCLUDING A PLURALITY OF SUB-PIXEL

The present application claims priority under 35 U.S.C. §119(a) of Korean Patent Application No. 10-2014-0169888 filed on Dec. 1, 2014, which is hereby incorporated by reference in its entirety.

BACKGROUND

Field of the Disclosure

The present application relates to a display device.

Description of the Related Art

With development of information electronic devices, which display for images with high definition and quality, such as portable devices including mobile phones and notebook computer, high definition television receivers and so on, demands for flat panel display devices being applied to the information electronic devices are being increased. The flat panel display devices include liquid crystal display (LCD) devices, plasma display panels (PDPs), field emission display (FED) devices, organic light emitting diode (OLED) display devices and so on. Such flat panel display devices have been actively researched, but the LCD devices are being spotlighted because of their features of easy mass production, easy driving means and realization of high image quality and large size.

The LCD device displays an image by adjusting a light transmittance of a liquid crystal cell on a liquid crystal panel according to a gray scale value of a data signal. However, light transmission properties of the liquid crystal cells arranged on the liquid crystal panel deteriorate when a direct current voltage is applied to the liquid crystal cells for a long time. This results from the fact that a fixation phenomenon of the direct current voltage is generated. Due to this, a residual image is generated in an image displayed on the liquid crystal panel.

To address the above-mentioned the fixation phenomenon of the direct current voltage, inversion mode LCD devices are proposed which allow a data signal applied to the liquid crystal cell to be polarity-inverted on the basis of a common voltage. The inversion mode can be classified into a frame inversion mode, a line inversion mode, column mode and a dot inversion mode.

The dot inversion mode among such inversion modes can display images with a superior quality compared to the frame inversion mode and the line inversion mode. However, the LCD device driven in the dot inversion mode can deteriorate the image quality according to a correlative relationship between the polarities of data voltages charged into the liquid crystal cells and a displayed image pattern. This results from the fact that one of the positive and negative polarities becomes a superior polarity according to the data voltage charged in the liquid crystal cell. The superior polarity is caused by the unbalance between positive and negative polarities in the data voltages charged into the liquid crystal cells. As such, the same color liquid crystal cells adjacent to one another in vertical and horizontal directions of the panel can be charged with the same polarity. Due to this, the image quality of the LCD device can deteriorate. Alternatively, the LCD device can be driven in a vertical 4-dot inversion mode in order to address the unbalance between the positive and negative polarities. In this case, however, power consumption by the LCD device increases.

BRIEF SUMMARY

Accordingly, embodiments of the present application are directed to a display panel that substantially obviates one or more of problems due to the limitations and disadvantages of the related art.

The embodiments provide a display panel that is adapted to enhance the transmittance by further including a white sub-pixel.

Also, embodiments provide a display panel adapted to reduce consumption power.

Moreover, the embodiments provide a display panel adapted to prevent the polarity unbalance.

Furthermore, the embodiments provide a display panel adapted to prevent image quality defects which are caused by the polarity unbalance.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a general aspect of the present embodiments, a display panel includes: a plurality of gate lines and a plurality of data lines disposed to cross each other and define a plurality of sub-pixel regions; and a plurality of sub-pixels disposed in the plurality of sub-pixel regions and configured to share one of the data lines adjacent thereto, wherein the sub-pixels sharing the same data line are arranged in a shape of zigzagging along a vertical direction by four sub-pixels. The plurality of sub-pixels includes sub-pixels configured to display red, green, blue and white. The plurality of data lines is divided into plural groups which each include first through fourth data lines used to transfer data voltages with polarities corresponding to one of "+, −, −, +" and "−, +, +, −" and fifth through eighth data lines used to transfer the data voltages with contrary polarities to those of the data voltage on the first through fourth data lines. The data voltages are inverted in polarity every frame. In this manner, the sub-pixels are arranged in a shape of zigzagging every four sub-pixels. As such, the same color sub-pixels adjacent to one another are not charged with the same polarity. Also, the polarity inversion being performed every frame can not only induce an inversion effect but also reduce power consumption. Moreover, it is evident that the same color sub-pixels charged with the same polarity are not disposed when a diagonal line pattern is displayed on the display panel. Furthermore, the same polarity is developed in the shape of zigzagging alone the vertical direction every 4 sub-pixels. In accordance therewith, the generation of a flicker phenomenon in a fixed pattern, such as a horizontal line, a diagonal line or other, can be prevented.

A display panel according to another general aspect of the present embodiments allows the sub-pixel regions to include a thin-film-transistor-inclusive sub-pixel region connected to pixel electrodes which are included in the sub-pixels adjacent to the thin-film-transistor-inclusive sub-pixel region. The thin-film-transistor-inclusive sub-pixel region includes thin film transistors connected to three sub-pixels adjacent to the thin-film-transistor-inclusive sub-pixel region. The sub-pixel disposed in the thin-film-transistor-inclusive sub-pixel region is used to display white. The thin film transistors include: a first thin film transistor connected to the pixel electrode which is disposed on the sub-pixel region adjacent to one of left and right edges of the thin-film-transistor-inclusive sub-pixel region; a second thin film transistor connected to the pixel electrode which is disposed on the sub-pixel adjacent to a bottom edge of the thin-film-transistor-inclusive sub-pixel region; and a third thin film transistor connected to the pixel electrode which is disposed on the sub-pixel region adjacent to the thin-film-transistor-inclusive sub-pixel region in one of downward diagonal directions. The thin-film-transistor-inclusive sub-pixel region includes a smaller sized pixel electrode compared to the pixel electrodes which are disposed on the sub-pixel regions adjacent thereto. The thin-film-transistor-inclusive sub-pixel region further includes a fourth transistor which is connected to the pixel electrode disposed in the thin-film-transistor-inclusive sub-pixel region. In this manner, such a display panel according to another general aspect of the present embodiments includes the white sub-pixels. As such, brightness of the display panel can increase and power consumption due to the increment of brightness can be reduced. Also, the thin film transistors used to drive the red, green and blue sub-pixels are disposed in the white sub-pixel region adjacent to the red, green and blue sub-pixels. As such, the sizes of the pixel electrodes included in the red, green and blue sub-pixels can be enlarged. In accordance therewith, color gamut of the display panel can be enhanced. In other words, such an asymmetric pixel electrode structure can not only enhance color gamut of the display panel but also reduces power consumption which is caused by the increment of brightness.

A display panel according to still another general aspect of the present embodiments includes: a plurality of gate lines and a plurality of data lines disposed to cross each other and define a plurality of sub-pixel regions; and a plurality of sub-pixels disposed in the plurality of sub-pixel regions, wherein the plurality of sub-pixel regions includes thin-film-transistor-inclusive sub-pixel regions which each include thin film transistors connected to pixel electrodes of the sub-pixels adjacent to the thin-film-transistor-inclusive sub-pixel region. The sub-pixel disposed in the thin-film-transistor-inclusive sub-pixel region is used to display white. The thin film transistors include: a first thin film transistor connected to the pixel electrode which is disposed on the sub-pixel region adjacent to one of left and right edges of the thin-film-transistor-inclusive sub-pixel region; a second thin film transistor connected to the pixel electrode which is disposed on the sub-pixel adjacent to a bottom edge of the thin-film-transistor-inclusive sub-pixel region; and a third thin film transistor connected to the pixel electrode which is disposed on the sub-pixel region adjacent to the thin-film-transistor-inclusive sub-pixel region in one of downward diagonal directions. The plurality of sub-pixels includes: first sub-pixels configured to each display a first color; second sub-pixels configured to each display a second color; third sub-pixels configured to each display a third color; and fourth sub-pixels configured to each display a fourth color. The first through fourth sub-pixels share a single data line (or the same data line) and are arranged in a shape of zigzagging along a vertical direction by twos. The plurality of data lines is divided into plural groups which each include first through fourth data lines used to transfer data voltages with polarities corresponding to one of "+, −, −, +" and "−, +, +, −" and fifth through eighth data lines used to transfer the data voltages with contrary polarities to those of the data voltage on the first through fourth data lines. The data voltages are inverted in polarity every frame. If the sub-pixels are arranged in a shape of zigzagging every four sub-pixels, the same color sub-pixels adjacent to one another are not charged with the same polarity. The polarity inversion being performed every frame can not only induce an inversion effect but also reduce power consumption. It is evident that the same color sub-pixels charged with the same polarity are not disposed when a diagonal line pattern is displayed on the display panel 100. Also, the same polarity is developed in the shape of zigzagging alone the vertical direction every 4 sub-pixels. In accordance therewith, the generation of a flicker phenomenon in a fixed pattern, such as a horizontal line, a diagonal line or other, can be prevented.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
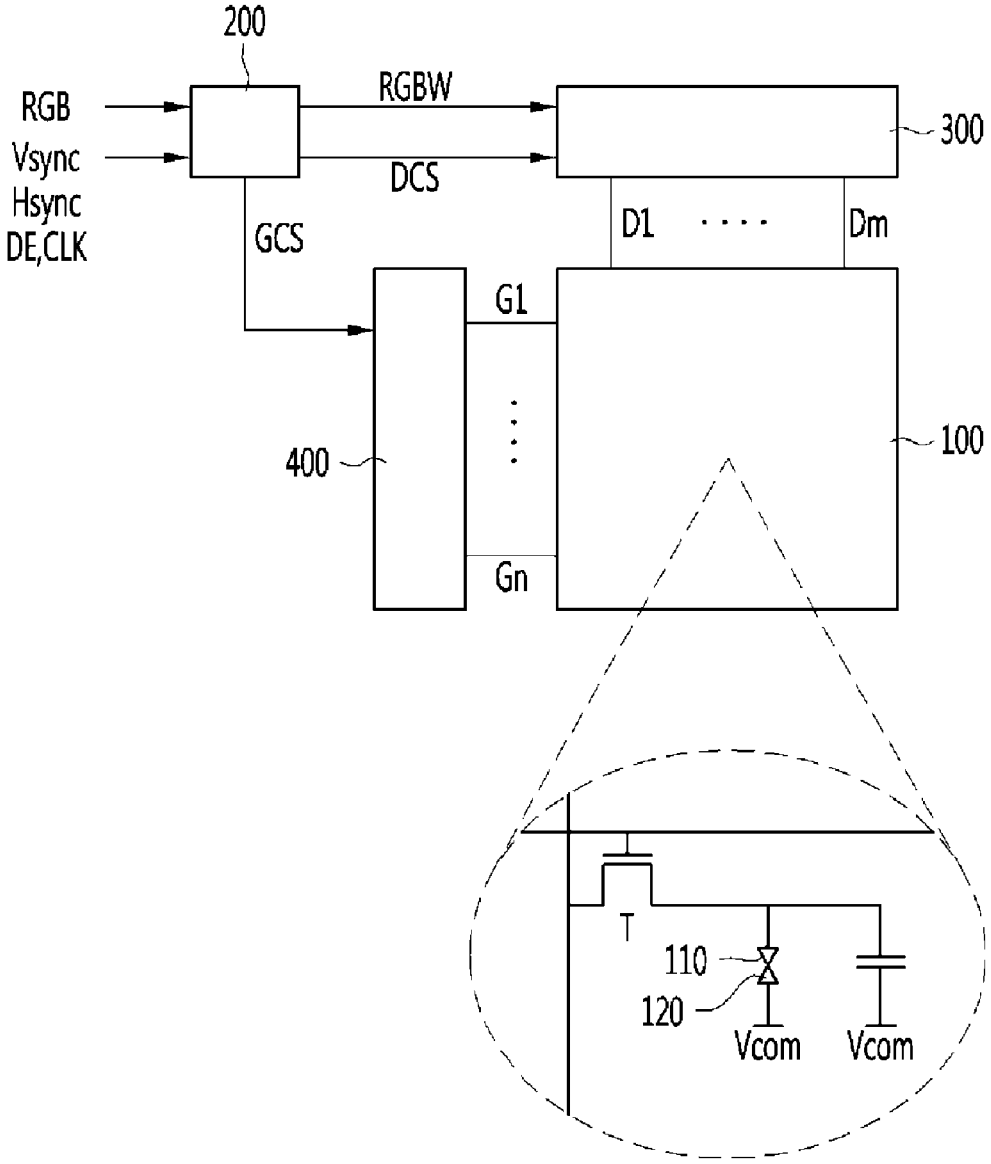
FIG. 1 is a block diagram showing an LCD device according to an embodiment of the present invention.

Reference will now be made in detail to display panels according to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

Advantages and features of the present disclosure, and implementation methods thereof will be clarified through the following embodiments described with reference to the accompanying drawings. These embodiments introduced hereinafter are provided as examples in order to convey their spirits to the ordinary skilled person in the art. As such, these embodiments might be embodied in a different shape, so are not limited to these embodiments described here. Therefore, the present disclosure must be defined by scopes of claims. The same reference numbers will be used throughout this disclosure to refer to the same or like parts. The size or the relative size of a layer or a region in the drawings can be exaggerated for the definiteness of explanation.

The terms within the present disclosure are used for explaining embodiments, but they do not limit the present disclosure. As such, the singular forms used in the present disclosure are intended to include the plural forms, unless the context clearly indicates otherwise. The terms "comprises" and/or "comprising" described in the present disclosure specify the presence of stated components, steps, operations and/or elements, but do not preclude the presence or addition of one or more other components, steps, operations, elements and/or groups thereof.

[LCD Device According to the Embodiment]

FIG. 1 is a block diagram showing an LCD device according to an embodiment of the present disclosure.

Referring to FIG. 1, the LCD device according to an embodiment of the present disclosure includes a display panel 100, a timing controller 200, a data driver 300 and a gate driver. All the components of the LCD device in this embodiment and all other embodiments are operatively coupled and configured.

The display panel 100 includes liquid crystal molecules interposed between two glass substrates. The display panel 100 is defined into m×n of sub-pixel regions which are arranged in a matrix shape by a plurality of data lines D1~Dm and a plurality of gate lines G1~Gn crossing each other. Such a display panel 100 includes liquid crystal cells arranged in the sub-pixel regions. The alphabets "m" and "n" are positive integers.

The sub-pixel regions defined by the pluralities of data and gate lines D1~Dm and G1~Gn include first sub-pixels, second sub-pixels, third sub-pixels and fourth sub-pixels. The first sub-pixel is used to display a first color. The second sub-pixel is used to display a second color. The third sub-pixel is used to display a third color. The fourth sub-pixel is used to display a fourth color.

The sub-pixels, the m data lines D1~Dm and the n data lines G1~Gn are formed on a lower glass substrate of the display panel 100. Each of the sub-pixels includes a thin film transistor T, a pixel electrode 110 of the liquid crystal cell Clc and a storage capacitor Cst. The pixel electrode 110 and the storage capacitor Cst are connected to the thin film transistor T.

A black matrix, a color filter layer and a common electrode 120 are formed on an upper glass substrate of the display panel 100. The common electrode 120 disposed on the upper glass substrate allows the display panel 100 to be driven in a vertical field mode such as one of a TN (twisted nematic) mode and a VA (vertical alignment) mode. Alternatively, the common electrode 120 can be formed on the lower glass substrate in order to drive the display panel 100 in a horizontal field mode such as one of an IPS (in-plane switching) mode and an FFS (fringe field switching) mode.

Also, the display panel 100 includes polarizing plates which have light axes cross each other at right angles and are attached on outer surfaces of the lower and upper glass substrates. Moreover, the display panel 100 includes alignment films which are disposed on inner surfaces of the lower and upper glass substrates, in order to set a pretilt angle of the liquid crystal molecules.

The data driver 300 can include a plurality of data driving IC (integrated circuit) chips. Also, the data driver 300 latches digital video data RGBW and converts the latched digital video data RGBW into a plurality of analog data voltages using positive/negative gamma compensation voltages, under control of the timing controller 200. Each of the data driving IC chips can apply the converted analog data voltages to a fixed number of data lines among the plurality of data lines D1~Dm. As such, the number of data driving IC chips included in the data driver 300 can depend on definition of the LCD device (i.e., the display panel 100) and the number of output channels of the data driving IC chip.

The data voltages are applied from the data driver 300 to the data lines D1~Dm on the display panel 100 for a single horizontal period when a source output enable signal SOE maintains a low logic state.

The data driving IC chips are loaded on TCPs (tape carrier packages). The TCPs loaded with the data driving IC chips can be bonded to the lower glass substrate of the display panel 100 through a TAB (tape automated bonding) process.

The gate driver 400 includes a shift register, a level shifter, an output buffer and so on. The level shifter converts a swing width of output signals (i.e., gate pulse) of the shift register in another swing width suitable to driving the thin film transistors T of the sub-pixels, and an output buffer connected between the level shifter and the gate lines G1~Gn on the display panel 100. Such a gate driver 400 sequentially applies gate signals to the gate lines G1~Gn on the display panel 100. Each of the gate signals has a pulse width corresponding to about a single horizontal period. Also, the gate driver 400 can be loaded on one TCP which is bonded to the lower glass substrate through the TAB process. Alternatively, the gate driver 400 can be simultaneously formed on the lower glass substrate in a GIP (gate driver in-panel) mode when a pixel array (i.e., the sub-pixels) is formed on the lower glass substrate.

The timing controller 200 converts digital video data RGB of a first type applied from a system board (not shown) into the digital video data RGBW of a second type and rearranges the digital video data RGBW of the second type in a suitable format for the display panel 100. The rearranged digital video data RGBW is applied from the timing controller 200 to the data driver 300. The first type digital video data RGB includes red, green and blue sub-pixel data signals, and the second type digital video data RGBW includes red, green, blue and white sub-pixel data signals. Also, the timing controller 200 derives timing control signals GCS and DCS from timing signals which are applied from the system board and include vertical/horizontal synchronous signals Vsync and Hsync, a data enable signal DE, a clock signal CLK and so on. The timing control signals GCS and DCS include gate timing control signals GCS used to control operative timings of the gate driver 400 and data timing control signals DCS used to control operative timings of the data driver 300.

The gate timing control signals GCS used to control the gate driver 400 include a gate start pulse GSP, a gate shift clock signal GSC, a gate output enable signal GOE and so on. The gate start pulse GSP is generated once every frame period at a start time point of the frame period. Such a gate start pulse GSP is used to generate a first gate pulse. The gate shift clock signal GSC is commonly applied to a plurality of stages included in the shift register. Also, the gate shift clock signal GSC is used to shift the gate pulse along the stages. The gate output enable signal GOE controls output timings of the gate driver 400.

The data timing control signals DCS used to control the data driver 300 include a source start pulse SSP, a source sampling clock signal SSC, a vertical polarity control signal POL, a source output enable signal SOE and so on. The source start pulse SSP is used to control a start timing of a data sampling operation of the data driver 300. The source sampling clock signal SSC is used to control the data sampling timings of the data driving IC chips of the data driver 300. In detail, each of the data driving IC chips performs the data sampling operation in response to one of rising and falling edge of a source sampling clock of the source sampling clock signal SSC. The vertical polarity control signal POL controls a vertical polarity inversion timing of the data voltage, which is output from the data driver 300, along the gate lines. The source output enable signal SOE is used to control output timings of the data driver 300.

The data driver 300 latches the digital video data RGBW applied from the timing controller 200 under control of the timing controller 200. Also, the data driver 300 selects one of the analog positive and negative gamma compensation voltages in response to the vertical polarity control signal POL and converts the input digital video data RGBW into the analog data voltages on the basis of the analog gamma compensation voltages with the selected polarity. The converted data voltages are simultaneously applied from the data driver 300 to on the display panel 100 through all the data lines D1~Dm.

If the vertical polarity control signal with a high logic is applied from the timing controller 20, the analog data voltage output from the data driver 300 can have a positive polarity. On the contrary, when the vertical polarity control signal applied from the timing controller has a low logic, the analog data voltage output from the data driver 300 can have a negative polarity.

The polarity inversion of the data voltage controlled by the vertical polarity control signal POL can be performed in contrary manners to each other according to vertical lines (i.e., the data lines D1~Dm).

[Display Panel According to First Embodiment]

Figure 2:
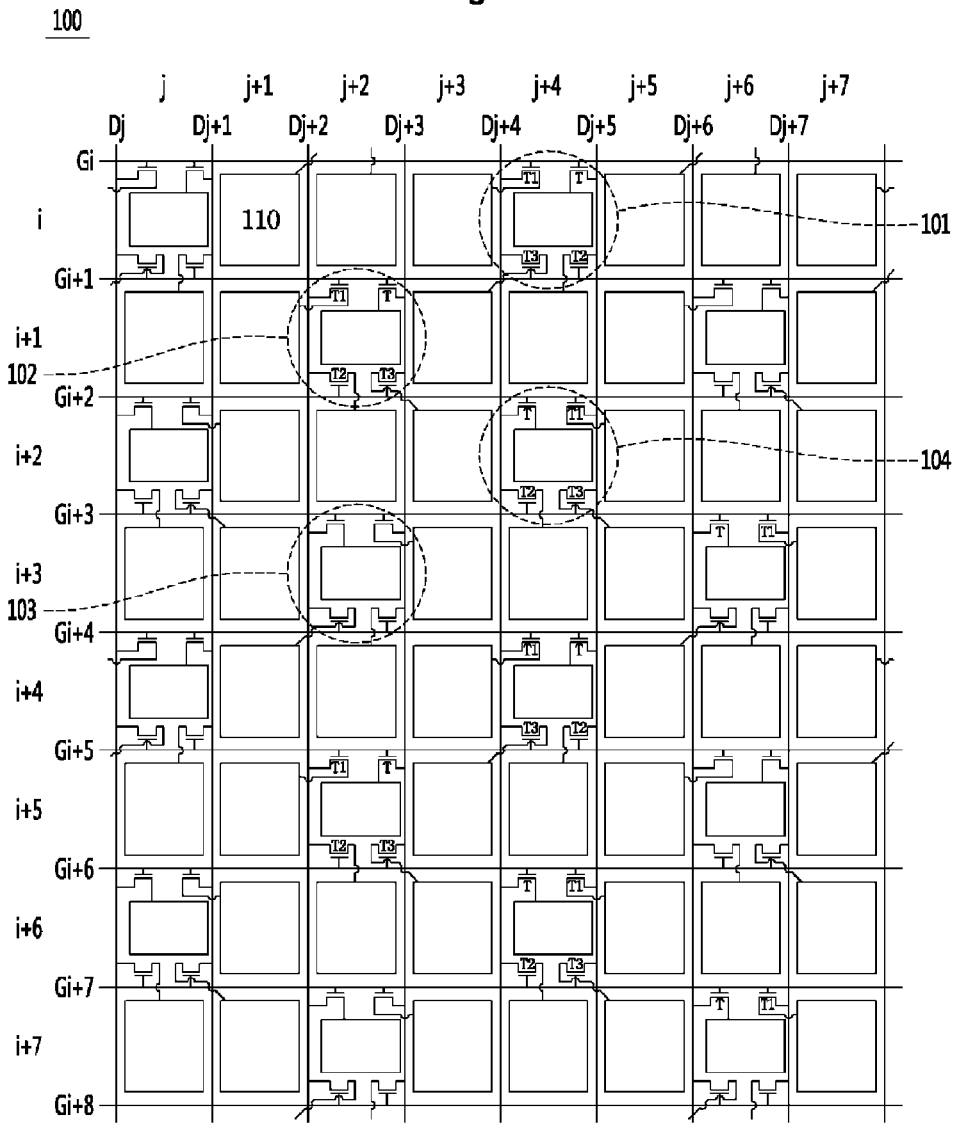
FIG. 2 is a circuit diagram showing a pixel arrangement of a display panel according to a first embodiment of the present invention.

FIG. 2 is a circuit diagram showing a pixel arrangement of a display panel according to a first embodiment of the present disclosure.

For the convenience of explanation, it is assumed that "i" means an ith row (or an ith horizontal array), "j" means a jth column (or a vertical array), and "i, j" indicates a sub-pixel region or a sub-pixel positioned at an intersection of the ith row and the jth column. A single row is disposed between two adjacent gate lines to each other, and a single column is disposed between two adjacent data lines to each other. The "i" and "j" are natural numbers. In one example, "i" and "j" are positive integers.

Referring to FIG. 2, the display panel 100 according to the first embodiment of the present disclosure includes a plurality of data lines Dj~Di+7 and a plurality of gate lines Gi~Gi+7 crossing each other. The display panel 100 can be defined into a plurality of sub-pixel regions by the plurality of data lines Dj~Dj+7 and the plurality of gate lines Gi~Gi+7 crossing each other.

In the display panel 100 according to the first embodiment of the present disclosure, the thin film transistors T transferring the data voltages on the data lines Dj~Dj+7 to the pixel electrodes 110 of the respective sub-pixels in response to the gate signals on the data lines Gi~Gi+7 can be disposed within fixed sub-pixel regions 101, 102, 103 and 104 by a fixed number (for example, by fours). In other words, the fixed number of thin film transistors T (for example, four thin film transistors T) can be disposed in a fixed sub-pixel region 101, 102, 103 or 104. The fixed sub-pixel regions 101, 102, 103 and 104 further including the thin film transistors, which are connected to the pixel electrode of adjacent sub-pixel regions thereto, can be defined as "sub-pixel regions for thin film transistor (hereinafter, thin-film-transistor-inclusive sub-pixel regions 101, 102, 103 and 104)".

Each of the thin-film-transistor-inclusive sub-pixel regions 101, 102, 103 and 104 can include one thin film transistor T connected to the respective sub-pixel and three thin film transistors T1, T2 and T3 connected to three sub-pixels adjacent to the respective sub-pixel. In other words, first through third thin film transistors T1, T2 and T3 with the exception of the respective thin film transistor T can be formed in a thin-film-transistor-inclusive sub-pixel region 101, 102, 103 or 104. The first thin film transistor T1 is connected to one pixel electrode disposed in a sub-pixel region which is adjacent to one of left and right of the thin-film-transistor-inclusive sub-pixel region 101, 102, 103 or 104. The second thin film transistor T2 is connected to another pixel electrode disposed in another sub-pixel region which is adjacent to a bottom edge of the thin-film-transistor-inclusive sub-pixel region 101, 102, 103 or 104. The third thin film transistor T3 is connected to still another pixel electrode disposed in still another sub-pixel region which is adjacent to the thin-film-transistor-inclusive sub-pixel region 101, 102, 103 or 104 in one of downward diagonal directions. The respective thin film transistor T is connected to further still another pixel electrode disposed in the thin-film-transistor-inclusive sub-pixel region 101, 102, 103 or 104.

The thin-film-transistor-inclusive sub-pixel regions can include first through fourth type thin-film-transistor-inclusive sub-pixel regions 101, 102, 103 and 104.

[First Type Thin-Film-Transistor-Inclusive Sub-Pixel Region According to First Embodiment]

A first type thin-film-transistor-inclusive sub-pixel region 101 can be defined as an intersection of an ith row and a jth column. Also, four thin film transistors can be disposed in the first type thin-film-transistor-inclusive sub-pixel region 101. One thin film transistor can be connected to one sub-pixel opposite to the intersection of the ith row and the jth column. Another thin film transistor can be connected to another sub-pixel opposite to an intersection of the ith row and a (j−1)th column. Still another thin film transistor can be connected to still another sub-pixel opposite to an intersection of an (i+1)th row and the (j−1)th column. Further still another thin film transistor T3 can be connected to further still another sub-pixel opposite to an intersection of the (i+1)th row and the jth column.

[Second Type Thin-Film-Transistor-Inclusive Sub-Pixel Region According to First Embodiment]

A second type thin-film-transistor-inclusive sub-pixel region 102 can be defined as an intersection of an ith row and a jth column. Also, four thin film transistors can be disposed in the second thin-film-transistor-inclusive sub-pixel region 102. One thin film transistor can be connected to one sub-pixel opposite to the intersection of the ith row and the jth column. Another thin film transistor can be connected to another sub-pixel opposite to an intersection of the ith row and a (j−1)th column. Still another thin film transistor can be connected to still another sub-pixel opposite to an intersection of an (i+1)th row and the jth column. Further still another thin film transistor T3 can be connected to further still another sub-pixel opposite to the intersection of the (i+1)th row and a (j+1)th column.

[Third Type Thin-Film-Transistor-Inclusive Sub-Pixel Region According to First Embodiment]

A third type thin-film-transistor-inclusive sub-pixel region 103 can be defined as an intersection of an ith row and a jth column. Also, four thin film transistors can be disposed in the third type thin-film-transistor-inclusive sub-pixel region 103. One thin film transistor can be connected to one sub-pixel opposite to the intersection of the ith row and the jth column. Another thin film transistor can be connected to another sub-pixel opposite to an intersection of the ith row and a (j+1)th column. Still another thin film transistor can be connected to still another sub-pixel opposite to an intersection of an (i+1)th row and a (j−1)th column. Further still another thin film transistor can be connected to further still another sub-pixel opposite to an intersection of the (i+1)th row and the jth column.

[Fourth Type Thin-Film-Transistor-Inclusive Sub-Pixel Region According to First Embodiment]

The fourth type thin-film-transistor-inclusive sub-pixel region 104 can be defined as an intersection of an ith row and a jth column. Also, four thin film transistors can be disposed in the fourth type thin-film-transistor-inclusive sub-pixel region 104. One thin film transistor can be connected to one sub-pixel opposite to the intersection of the ith row and the jth column. Another thin film transistor can be connected to another sub-pixel opposite to an intersection of the ith row and a (j+1)th column. Still another thin film transistor can be connected to still another sub-pixel opposite to an intersection of an (i+1)th row and the jth column. Further still another thin film transistor can be connected to further still another sub-pixel opposite to an intersection of the (i+1)th row and the (j+1)th column.

The sub-pixel arrangement of the display panel 100 will now be explained in detail with reference to the attached drawing. A thin film transistor T connected to one sub-pixel opposite to the intersection of the (i+1)th row and the (j+2)th column, another thin film transistor T1 connected to another sub-pixel opposite to an intersection of the (i+1)th row and a (j+1)th column, still another thin film transistor T2 connected to still another sub-pixel opposite to an intersection of an (i+2)th row and the (j+2)th column, and further still another thin film transistor T3 connected to further still another sub-pixel opposite to the intersection of the (i+2)th row and a (j+3)th column are disposed within a (i+1, j+2)th thin-film-transistor-inclusive sub-pixel region 102. Also, a thin film transistor T connected to a sub-pixel opposite to the intersection of the ith row and the (j+4)th column, another thin film transistor T1 connected to another sub-pixel opposite to an intersection of the ith row and a (j+3)th column, still another thin film transistor T2 connected to still another sub-pixel opposite to an intersection of an (i+1)th row and the (j+4)th column, and further still another thin film transistor T3 connected to further still another sub-pixel opposite to an intersection of the (i+1)th row and the (j+3)th column are disposed in an (i, j+4)th thin-film-transistor-inclusive sub-pixel region 101. Moreover, a thin film transistor T connected to a sub-pixel opposite to the intersection of an (i+3)th row and a (j+2)th column, another thin film transistor T1 connected to another sub-pixel opposite to an intersection of the (i+3)th row and a (j+3)th column, still another thin film transistor T2 connected to still another sub-pixel opposite to an intersection of an (i+4)th row and the (j+2)th column, and further still another thin film transistor T3 is connected to further still another sub-pixel opposite to an intersection of the (i+4)th row and a (j+1)th column are disposed in an (i+3, j+2)th thin-film-transistor-inclusive sub-pixel region 103. Furthermore, a thin film transistor T connected to one sub-pixel opposite to the intersection of an (i+2)th row and a (j+4)th column, another thin film transistor T1 connected to another sub-pixel opposite to an intersection of the (i+2)th row and a (j+5)th column, still another thin film transistor T2 connected to still another sub-pixel opposite to an intersection of an (i+3)th row and the (j+4)th column, and further still another thin film transistor T3 connected to further still another sub-pixel opposite to an intersection of the (i+3)th row and a (j+5)th column are disposed in an (i+2, j+4)th thin-film-transistor-inclusive sub-pixel region 104.

In this manner, the thin-film-transistor-inclusive sub-pixel region is defined as the intersection of the ith row and the jth column. Also, one thin film transistor connected to one sub-pixel opposite to the intersection of the ith row and the jth column, another thin film transistor connected to another sub-pixel opposite to an intersection of the ith row and one of (j−1)th and (j+1)th columns, still another thin film transistor connected to still another sub-pixel opposite to an intersection of an (i+1)th row and the jth column, and further still another thin film transistor connected to further still another sub-pixel opposite to the intersection of the (i+1)th row and one of the (j−1)th and (j+1)th columns are disposed in the thin-film-transistor-inclusive sub-pixel region. As such, the sub-pixels are arranged in a zigzag shape by twos. Therefore, a vertical 2-dot inversion effect and a color inversion effect can be obtained.

Also, the thin-film-transistor-inclusive sub-pixel region further loads thin film transistors which are used to drive adjacent sub-pixels thereto. As such, the sizes of the adjacent sub-pixels can be largely adjusted or sufficiently secured. In accordance therewith, the size of the sub-pixel can be easily adjusted on the basis of brightness and impression for each color.

[Color Sub-Pixel Arrangement According to First Embodiment]

Figure 3:
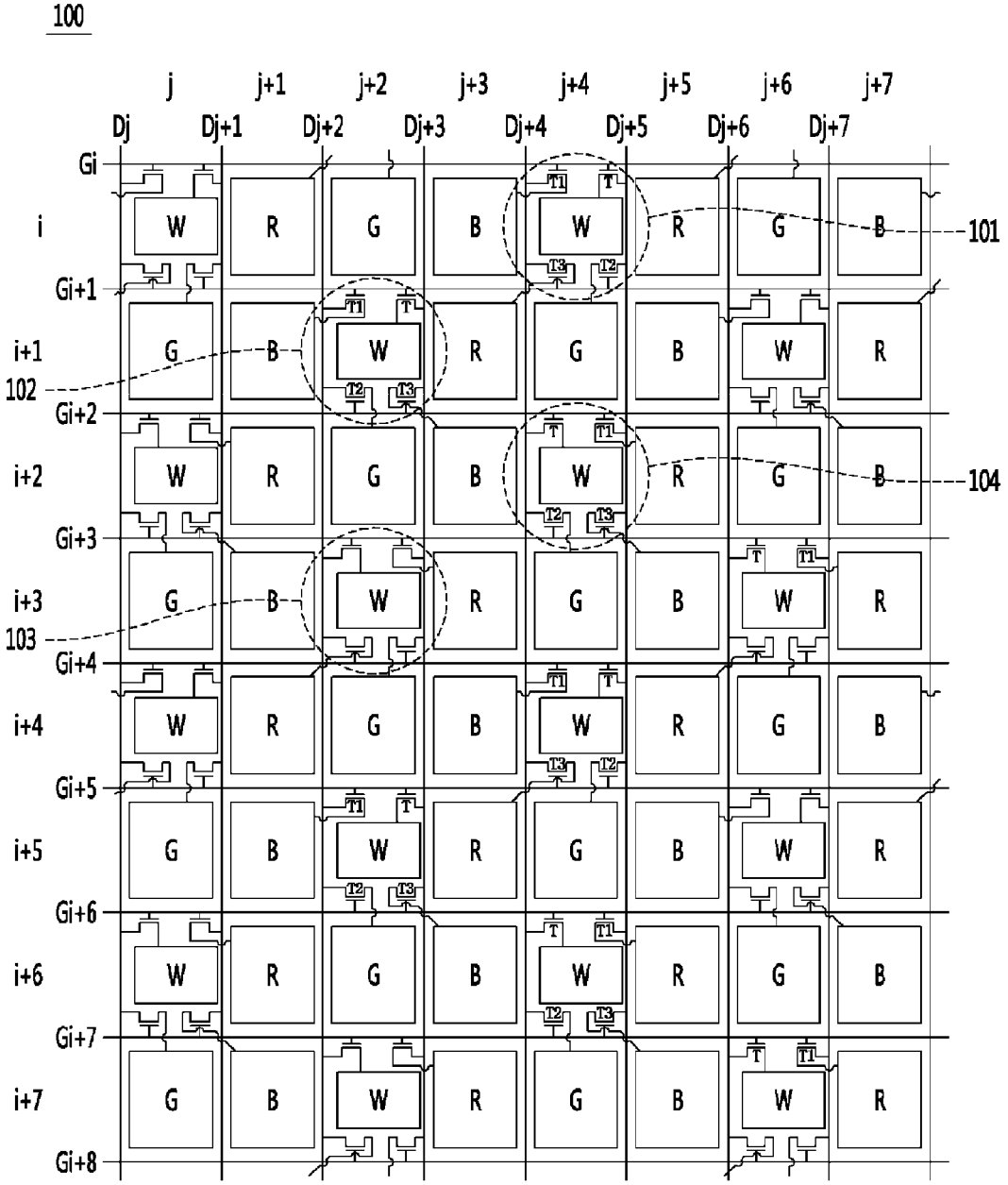
FIG. 3 is a circuit diagram showing a color sub-pixel arrangement of a display panel according to the first embodiment of the present invention.

FIG. 3 is a circuit diagram showing a color sub-pixel arrangement of a display panel according to the first embodiment of the present disclosure.

As shown in FIG. 3, the display panel 100 according to the first embodiment of the present disclosure can allow the sub-pixels to be arranged alternately with one another on odd-numbered rows in a sequence of a first sub-pixel, a second sub-pixel, a third sub-pixel and a fourth sub-pixel. Also, the sub-pixels can be arranged alternatively with one another on even-numbered rows in another sequence of the third sub-pixel, the fourth sub-pixel, the first sub-pixel and the second sub-pixel. The first sub-pixel can display a first color. The first color can be white. The second sub-pixel can display a second color. The second color can be red. The third sub-pixel can display a third color. The third color can be green. The fourth sub-pixel can display a fourth color. The fourth color can be blue.

As such, the display panel 100 according to the first embodiment of the present disclosure can include white, red, green and blue sub-pixels sequentially disposed in jth, (j+1)th, (j+2)th and (j+3)th regions of an ith row. Also, the display panel 100 can include the green, blue, white and red sub-pixels sequentially disposed in jth, (j+1)th, (j+2)th and (j+3)th regions of an (i+1)th row. Such a color sub-pixel arrangement can be repeated in horizontal and vertical directions. Also, the color sub-pixel arrangement allows the same color sub-pixels to be arranged in such a manner as to be separated from one another.

In detail, the white, red, green and blue sub-pixels can be sequentially disposed on the ith row and repeatedly disposed on the ith row along a right direction in the same sequence. As such, (i, j), (i, j+1), (i, j+2) and (i, j+3) sub-pixels can become the white, red, green and blue sub-pixels in sequence, and (i, j+4), (i, j+5), (i, j+6) and (i, j+7) sub-pixels can become the white, red, green and blue sub-pixels in sequence. Also, the green, blue, white and red sub-pixels can be sequentially disposed on the (i+1)th row and repeatedly disposed on the (i+1)th row along a right direction in the same sequence. As such, (i+1, j), (i+1, j+1), (i+1, j+2) and (i+1, j+3) sub-pixels can become the green, blue, white and red sub-pixels in sequence, and (i+1, j+4), (i+1, j+5), (i+1, j+6) and (i+1, j+7) sub-pixels can become the green, blue, white and blue sub-pixels in sequence. Moreover, the white, red, green and blue sub-pixels can be sequentially disposed on the (i+2)th row and repeatedly disposed on the (i+2)th row along a right direction in the same sequence. As such, (i+2, j), (i+2, j+1), (i+2, j+2) and (i+2, j+3) sub-pixels can become the white, red, green and blue sub-pixels in sequence, and (i+2, j+4), (i+2, j+5), (i+2, j+6) and (i+2, j+7) sub-pixels can become the white, red, green and blue sub-pixels in sequence. Furthermore, the green, blue, white and red sub-pixels can be sequentially disposed on the (i+3)th row and repeatedly disposed on the (i+3)th row along a right direction in the same sequence. As such, (i+3, j), (i+3, j+1), (i+3, j+2) and (i+3, j+3) sub-pixels can become the green, blue, white and red sub-pixels in sequence, and (i+3, j+4), (i+3, j+5), (i+3, j+6) and (i+3, j+7) sub-pixels can become the green, blue, white and blue sub-pixels in sequence. The other sub-pixels can be arranged along horizontal and vertical directions in the above-mentioned sub-pixel arrangement.

The white sub-pixels can be disposed in the thin-film-transistor-inclusive sub-pixel regions 101, 102, 103 and 104.

In this way, the white sub-pixels are formed in the thin-film-transistor-inclusive sub-pixel regions 101, 102, 103 and 104. As such, the pixel electrode of the white sub-pixel has a smaller size compared to those the pixel electrodes of the other color sub-pixels. In other words, the color sub-pixels can be formed in an asymmetric pixel electrode structure.

Such a display panel 100 according to the first embodiment of the present disclosure includes the white sub-pixels. As such, brightness of the display panel 100 can increase and power consumption due to the increment of brightness can be reduced. Also, the thin film transistors used to drive the red, green and blue sub-pixels are disposed in the white sub-pixel region adjacent to the red, green and blue sub-pixels. As such, the sizes of the pixel electrodes included in the red, green and blue sub-pixels can be enlarged. In accordance therewith, color gamut of the display panel 100 can be enhanced. In other words, such an asymmetric pixel electrode structure can not only enhance color gamut of the display panel 100 but also reduce power consumption which is caused by the increment of brightness.

[Polarity of Data Voltage According to First Embodiment]

Figure 4:
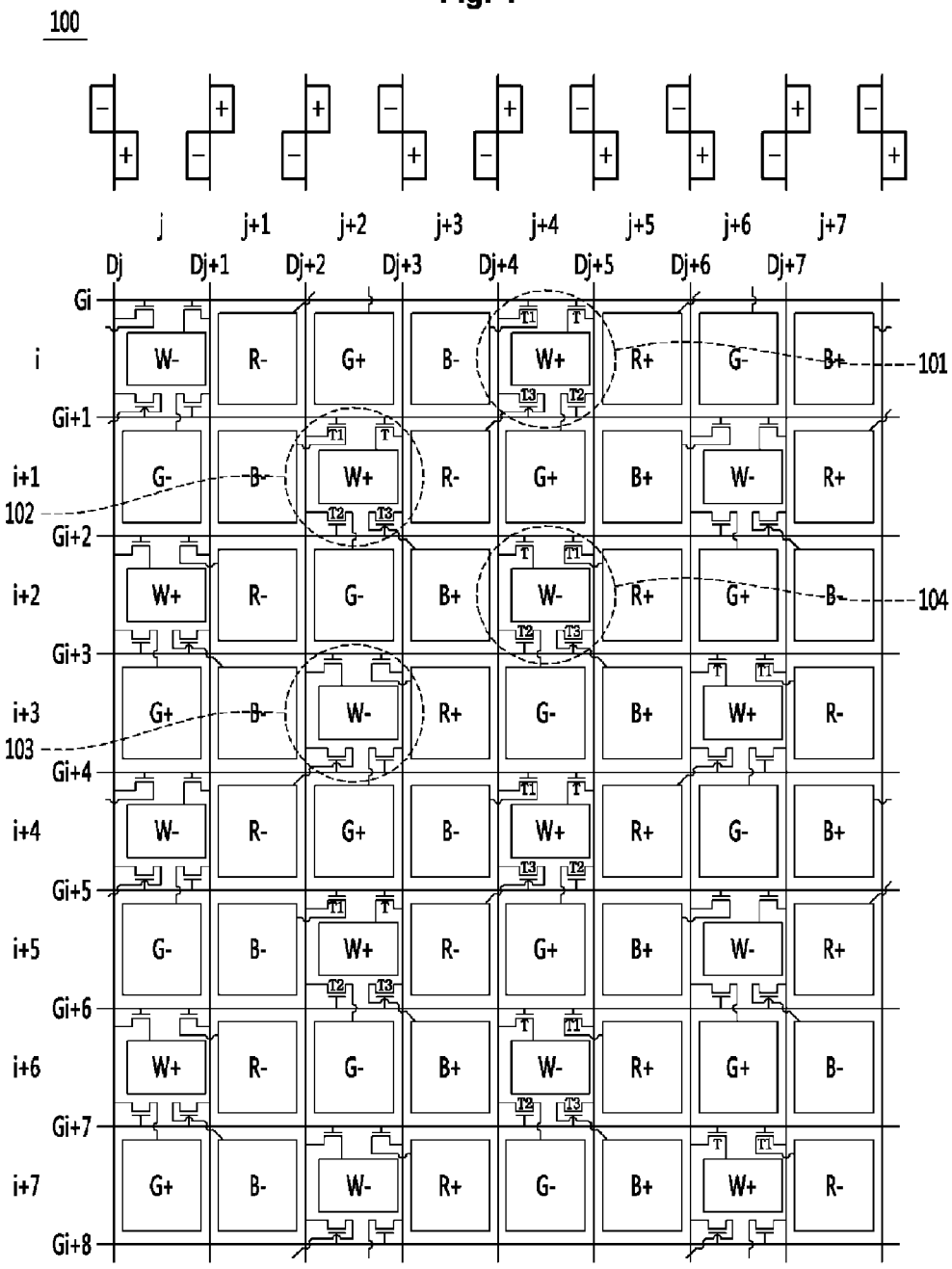
FIG. 4 is a circuit diagram showing a color sub-pixel arrangement of a display panel and a polarity distribution of data voltage thereon according to the first embodiment of the present invention.

FIG. 4 is a circuit diagram showing a color sub-pixel arrangement of a display panel and a polarity distribution of data voltage thereon according to the first embodiment of the present disclosure.

The data lines D1~Dm of the data driver 100 can be can be divided into a fixed number of data line groups. Each of the data line groups can include first through eighth data lines. One of data voltages on the first through fourth data lines can have one of negative (−) and positive (+) polarities and the other data voltages can have the other polarity. Alternatively, the data voltage of the first and fourth data lines can have one of the negative (−) and positive (+) polarities and the data voltages of the second and third data lines can have the other polarity. Also, the data voltages on the fifth through eighth data lines can have contrary polarities to those of the first through fourth data lines. For example, the data voltages on the first through eighth data lines Dj~Dj+7 can have polarities of "+, −, −, +, −, +, +, −" or "−, +, +, −, +, −, −, +" according to the rows, as shown in FIG. 4.

The polarities of the data voltages applied to the first through eighth data lines Dj~Dj+7 can be inverted every a single frame. Such a frame inversion inverting the polarity of the data voltage every a single frame can prevent the image quality defects which are caused by the polarization of liquid crystal.

For example, the data voltages having polarities of "+, −, −, +, −, +, +, −" in sequence can be written in color sub-pixels on a part of rows and the data voltages having polarities of "−, −, +, −, +, +, −, +" in sequence can be written in color sub-pixels on the other rows, as shown in FIG. 4. To this end, the data voltage applied to the first data line Dj can have the positive polarity (+), the data voltage applied to the second data line Dj+1 can have the negative polarity (−), the data voltage applied to the third data line Dj+2 can have the negative polarity (−), and the data voltage applied to the fourth data line Dj+3 can have the positive polarity (+). Also, the data voltages applied to the fifth through eighth data lines Dj+4 through Dj+7 can have contrary polarities to the data voltages applied to the first through fourth data lines Dj through Dj+3. In detail, the data voltage applied to the fifth data line Dj+4 can have the negative polarity (−), the data voltage applied to the sixth data line Dj+5 can have the positive polarity (+), the data voltage applied to the seventh data line Dj+6 can have the positive polarity (+), and the data voltage applied to the eighth data line Dj+7 can have the negative polarity (−). As such, the data voltages maintaining one of the positive and negative polarities during a single frame period can be transferred through the data lines Dj~Dj+7. The polarities of the data voltages transferred through the data lines Dj~Dj+7 can be inverted in next frame.

In this manner, the data voltages with the same polarity can be applied the sub-pixels which are connected to the same data line and arranged in the zigzag shape. Also, the data voltages each maintaining the same polarity during a single frame period can be applied to the data lines. As such, power consumption with respect to the inversion mode can be reduced.

In the display panel 100 according to the first embodiment of the present disclosure, the same polarity is developed in the shape zigzagging along a vertical direction every two sub-pixels. As such, when a mono color is displayed on the display panel 100, arrangement of the same polarity can be prevented (or minimized). Also, the polarity inversion being performed every frame can not only induce an inversion effect but also reduce power consumption.

[Display Panel According to Second Embodiment]

Figure 5:
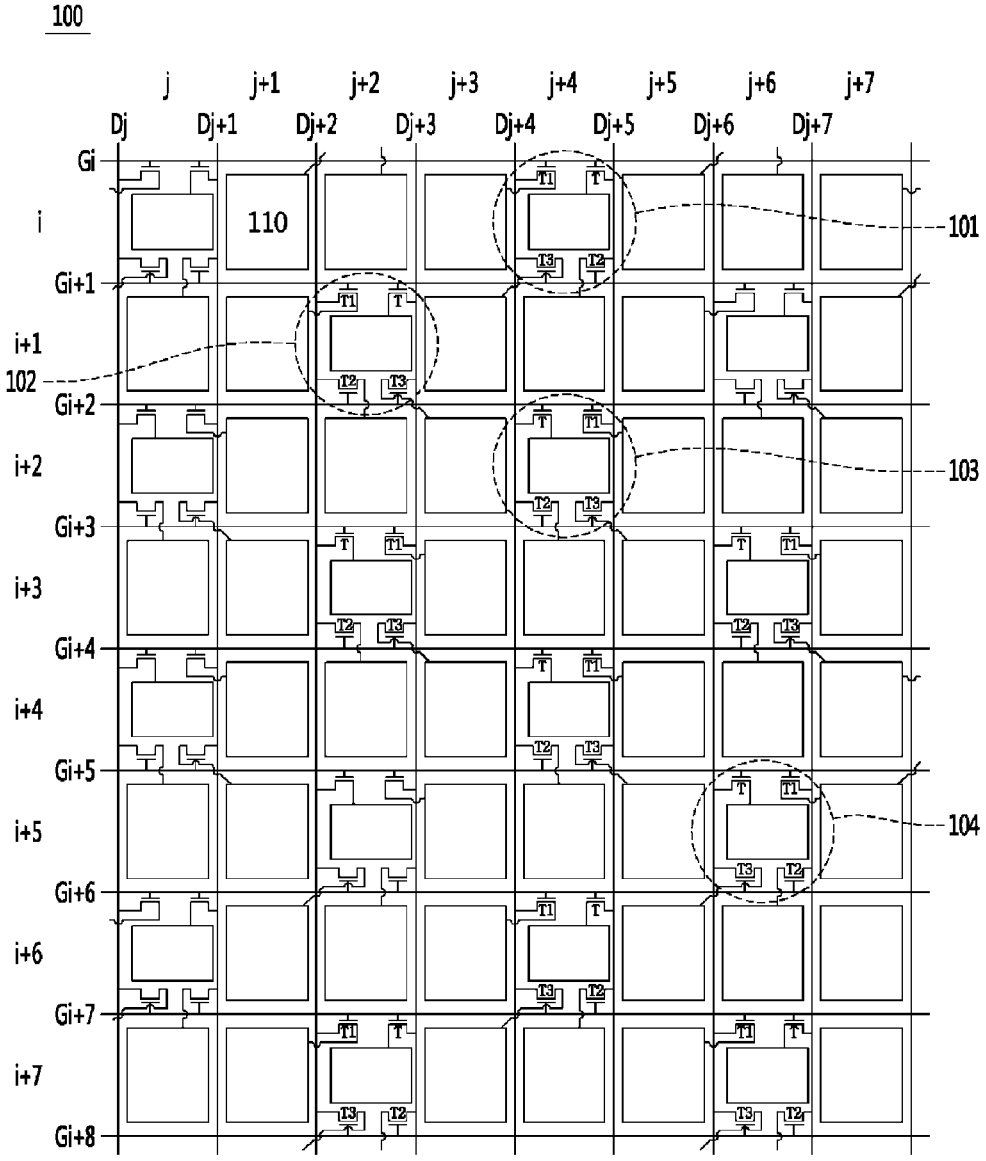
FIG. 5 is a circuit diagram showing a pixel arrangement of a display panel according to a second embodiment of the present invention.

FIG. 5 is a circuit diagram showing a pixel arrangement of a display panel according to the second embodiment of the present disclosure.

In the display panel 100 according to the second embodiment of the present disclosure, the thin film transistors T transferring the data voltages on the data lines Dj~Dj+7 to the pixel electrodes 110 of the respective sub-pixels in response to the gate signals on the data lines Gi~Gi+7 can be disposed within fixed sub-pixel regions 101, 102, 103 and 104 by a fixed number (for example, by fours) as shown in FIG. 5. In other words, the fixed number of thin film transistors T (for example, four thin film transistors T) can be disposed in a fixed sub-pixel region 101, 102, 103 or 104. The fixed sub-pixel regions 101, 102, 103 and 104 further including the thin film transistors, which are connected to the pixel electrode of adjacent sub-pixel regions thereto, can be defined as "sub-pixel regions for thin film transistor (hereinafter, thin-film-transistor-inclusive sub-pixel regions 101, 102, 103 and 104)".

Each of the thin-film-transistor-inclusive sub-pixel regions 101, 102, 103 and 104 can include one thin film transistor T connected to the respective sub-pixel and three thin film transistors T1, T2 and T3 connected to three sub-pixels adjacent to the respective sub-pixel. In other words, first through third thin film transistors T1, T2 and T3 with the exception of the respective thin film transistor T can be formed in a thin-film-transistor-inclusive sub-pixel region 101, 102, 103 or 104. The first thin film transistor T1 is connected to one pixel electrode disposed in a sub-pixel region which is adjacent to one of left and right edges of the thin-film-transistor-inclusive sub-pixel region 101, 102, 103 or 104. The second thin film transistor T2 is connected to another pixel electrode disposed in another sub-pixel region which is adjacent to a bottom edge of the thin-film-transistor-inclusive sub-pixel region 101, 102, 103 or 104. The third thin film transistor T3 is connected to still another pixel electrode disposed in still another sub-pixel region which is adjacent to the thin-film-transistor-inclusive sub-pixel region 101, 102, 103 or 104 in one of downward diagonal directions. The respective thin film transistor T is connected to further still another pixel electrode disposed in the thin-film-transistor-inclusive sub-pixel region 101, 102, 103 or 104.

The thin-film-transistor-inclusive sub-pixel regions can include first through fourth type thin-film-transistor-inclusive sub-pixel regions 101, 102, 103 and 104.

[First Type Thin-Film-Transistor-Inclusive Sub-Pixel Region According to Second Embodiment]

A first type thin-film-transistor-inclusive sub-pixel region 101 can be defined as an intersection of an ith row and a jth column. Also, four thin film transistors can be disposed in the first type thin-film-transistor-inclusive sub-pixel region 101. One thin film transistor can be connected to one sub-pixel opposite to the intersection of the ith row and the jth column. Another thin film transistor can be connected to another sub-pixel opposite to an intersection of the ith row and a (j−1)th column. Still another thin film transistor can be connected to still another sub-pixel opposite to an intersection of an (i+1)th row and the (j−1)th column. Further still another thin film transistor T3 can be connected to further still another sub-pixel opposite to an intersection of the (i+1)th row and the jth column.

[Second Type Thin-Film-Transistor-Inclusive Sub-Pixel Region According to Second Embodiment]

A second type thin-film-transistor-inclusive sub-pixel region 102 can be defined as an intersection of an ith row and a jth column. Also, four thin film transistors can be disposed in the second thin-film-transistor-inclusive sub-pixel region 102. One thin film transistor can be connected to one sub-pixel opposite to the intersection of the ith row and the jth column. Another thin film transistor can be connected to another sub-pixel opposite to an intersection of the ith row and a (j−1)th column. Still another thin film transistor can be connected to still another sub-pixel opposite to an intersection of an (i+1)th row and the jth column. Further still another thin film transistor T3 can be connected to further still another sub-pixel opposite to the intersection of the (i+1)th row and a (j+1)th column.

[Third Type Thin-Film-Transistor-Inclusive Sub-Pixel Region According to Second Embodiment]

The third type thin-film-transistor-inclusive sub-pixel region 103 can be defined as an intersection of an ith row and a jth column. Also, four thin film transistors can be disposed in the third type thin-film-transistor-inclusive sub-pixel region 103. One thin film transistor can be connected to one sub-pixel opposite to the intersection of the ith row and the jth column. Another thin film transistor can be connected to another sub-pixel opposite to an intersection of the ith row and a (j+1)th column. Still another thin film transistor can be connected to still another sub-pixel opposite to an intersection of an (i+1)th row and the jth column. Further still another thin film transistor can be connected to further still another sub-pixel opposite to an intersection of the (i+1)th row and the (j+1)th column.

[Fourth Type Thin-Film-Transistor-Inclusive Sub-Pixel Region According to Second Embodiment]

A fourth type thin-film-transistor-inclusive sub-pixel region 104 can be defined as an intersection of an ith row and a jth column. Also, four thin film transistors can be disposed in the fourth type thin-film-transistor-inclusive sub-pixel region 104. One thin film transistor can be connected to one sub-pixel opposite to the intersection of the ith row and the jth column. Another thin film transistor can be connected to another sub-pixel opposite to an intersection of the ith row and a (j+1)th column. Still another thin film transistor can be connected to still another sub-pixel opposite to an intersection of an (i+1)th row and a (j−1)th column. Further still another thin film transistor can be connected to further still another sub-pixel opposite to an intersection of the (i+1)th row and the jth column.

The sub-pixel arrangement of the display panel 100 will now be explained in detail with reference to the attached drawing. A thin film transistor T connected to one sub-pixel opposite to the intersection of the (i+1)th row and the (j+2)th column, another thin film transistor T1 connected to another sub-pixel opposite to an intersection of the (i+1)th row and a (j+1)th column, still another thin film transistor T2 connected to still another sub-pixel opposite to an intersection of an (i+2)th row and the (j+2)th column, and further still another thin film transistor T3 connected to further still another sub-pixel opposite to the intersection of the (i+2)th row and a (j+3)th column are disposed within a (i+1, j+2)th thin-film-transistor-inclusive sub-pixel region 102. Also, a thin film transistor T connected to a sub-pixel opposite to the intersection of the ith row and the (j+4)th column, another thin film transistor T1 connected to another sub-pixel opposite to an intersection of the ith row and a (j+3)th column, still another thin film transistor T2 connected to still another sub-pixel opposite to an intersection of an (i+1)th row and the (j+4)th column, and further still another thin film transistor T3 connected to further still another sub-pixel opposite to an intersection of the (i+1)th row and the (j+3)th column are disposed in an (i, j+4)th thin-film-transistor-inclusive sub-pixel region 101. Moreover, a thin film transistor T connected to one sub-pixel opposite to the intersection of an (i+2)th row and a (j+4)th column, another thin film transistor T1 connected to another sub-pixel opposite to an intersection of the (i+2)th row and a (j+5)th column, still another thin film transistor T2 connected to still another sub-pixel opposite to an intersection of an (i+3)th row and the (j+4)th column, and further still another thin film transistor T3 connected to further still another sub-pixel opposite to an intersection of the (i+3)th row and a (j+5)th column are disposed in an (i+2, j+4)th thin-film-transistor-inclusive sub-pixel region 103. Furthermore, a thin film transistor T connected to a sub-pixel opposite to the intersection of an (i+5)th row and a (j+6)th column, another thin film transistor T1 connected to another sub-pixel opposite to an intersection of the (i+5)th row and a (j+7)th column, still another thin film transistor T2 connected to still another sub-pixel opposite to an intersection of an (i+6)th row and the (j+6)th column, and further still another thin film transistor T3 is connected to further still another sub-pixel opposite to an intersection of the (i+6)th row and a (j+5)th column are disposed in an (i+5, j+6)th thin-film-transistor-inclusive sub-pixel region 104.

In this manner, the thin-film-transistor-inclusive sub-pixel region is defined as the intersection of the ith row and the jth column. Also, one thin film transistor connected to one sub-pixel opposite to the intersection of the ith row and the jth column, another thin film transistor connected to another sub-pixel opposite to an intersection of the ith row and one of (j−1)th and (j+1)th columns, still another thin film transistor connected to still another sub-pixel opposite to an intersection of an (i+1)th row and the jth column, and further still another thin film transistor connected to further still another sub-pixel opposite to the intersection of the (i+1)th row and one of the (j−1)th and (j+1)th columns are disposed in the thin-film-transistor-inclusive sub-pixel region. As such, the sub-pixels are arranged in a zigzag shape along a vertical direction by fours. Therefore, a vertical 4-dot inversion effect and a color inversion effect can be obtained.

[Color Sub-Pixel Arrangement According to Second Embodiment]

Figure 6:
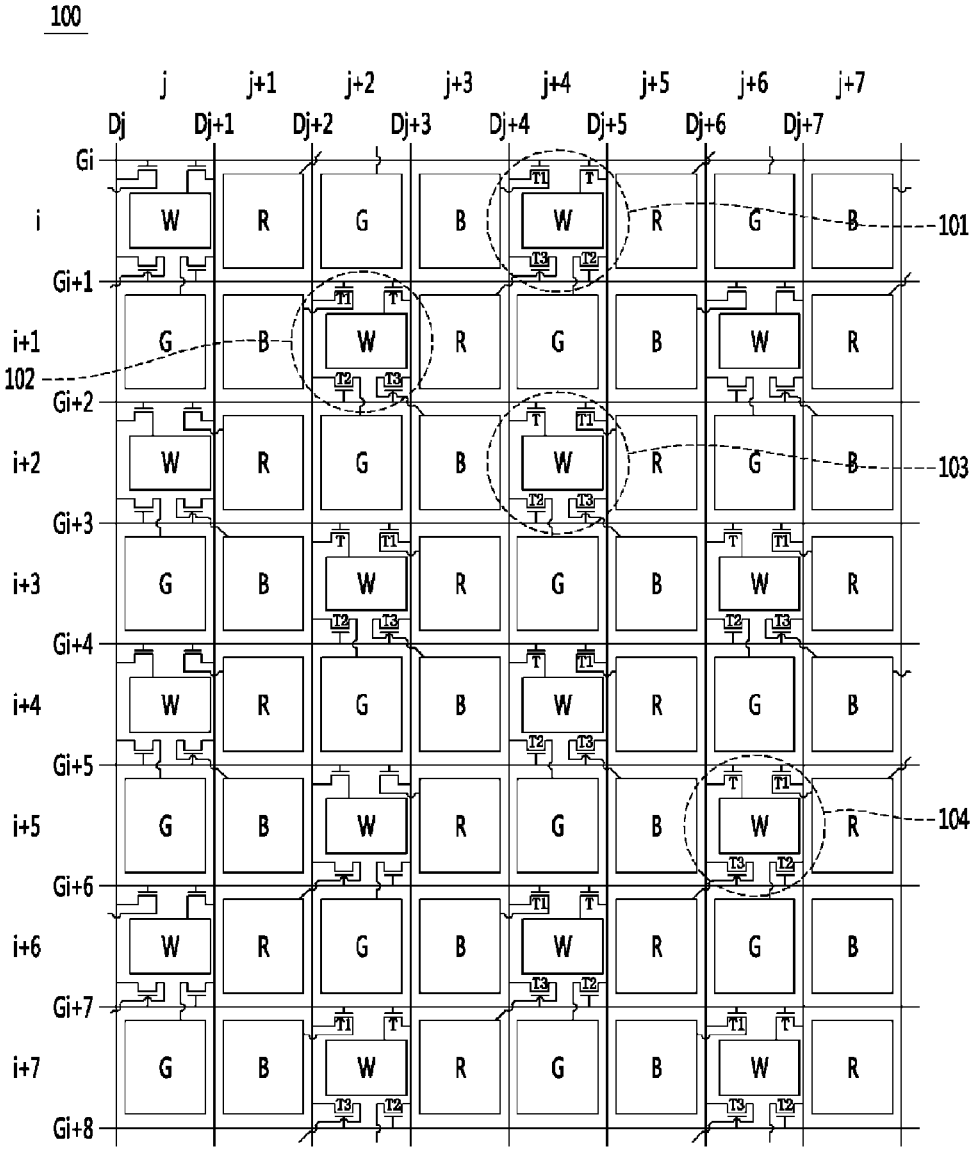
FIG. 6 is a circuit diagram showing a color sub-pixel arrangement of a display panel according to the second embodiment of the present invention.

FIG. 6 is a circuit diagram showing a color sub-pixel arrangement of a display panel according to the second embodiment of the present disclosure.

Referring to FIG. 6, the display panel 100 according to the second embodiment of the present disclosure can include white, red, green and blue sub-pixels sequentially disposed in jth, (j+1)th, (j+2)th and (j+3)th regions of an ith row. Also, the display panel 100 can include the green, blue, white and red sub-pixels sequentially disposed in jth, (j+1)th, (j+2)th and (j+3)th regions of an (i+1)th row. Such a color sub-pixel arrangement can be repeated in horizontal and vertical directions. Also, the color sub-pixel arrangement allows the same color sub-pixels to be arranged in such a manner as to be separated from one another.

The white sub-pixels can be disposed in the thin-film-transistor-inclusive sub-pixel regions 101, 102, 103 and 104.

In this way, the white sub-pixels are formed in the thin-film-transistor-inclusive sub-pixel regions 101, 102, 103 and 104. As such, the pixel electrode of the white sub-pixel has a smaller size compared to those the pixel electrodes of the other color sub-pixels. In other words, the color sub-pixels can be formed in an asymmetric pixel electrode structure.

Such a display panel 100 according to the first embodiment of the present disclosure includes the white sub-pixels. As such, brightness of the display panel 100 can increase and power consumption due to the increment of brightness can be reduced. Also, the thin film transistors used to drive the red, green and blue sub-pixels are disposed in the white sub-pixel region adjacent to the red, green. As such, the sizes of the pixel electrodes included in the red, green and blue sub-pixels can be enlarged. In accordance therewith, color gamut of the display panel 100 can be enhanced. In other words, such an asymmetric pixel electrode structure can not only enhance color gamut of the display panel 100 but also reduce power consumption which is caused by the increment of brightness.

[Polarity Distribution of Data Voltage According to First Embodiment]

Figure 7:
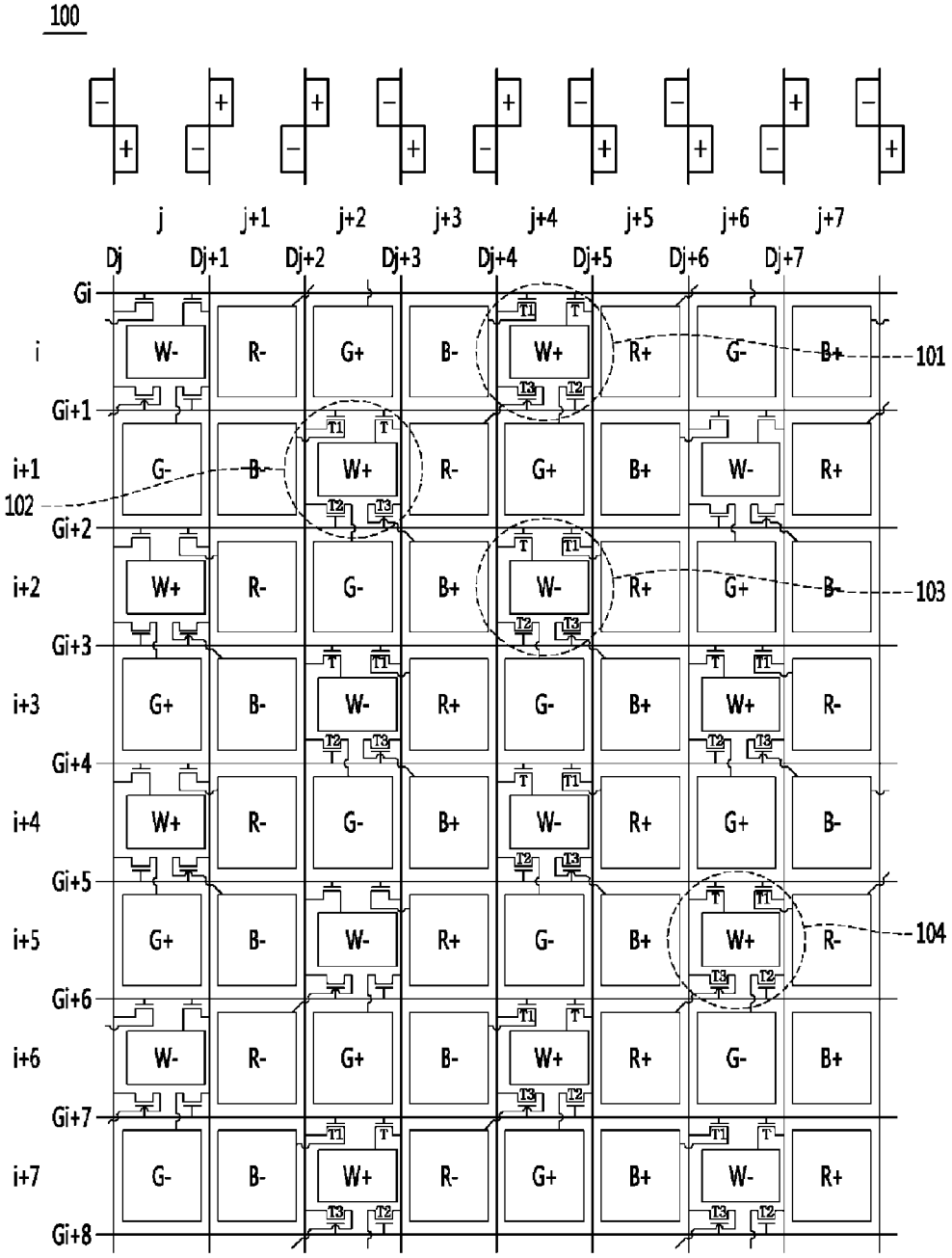
FIG. 7 is a circuit diagram showing a color sub-pixel arrangement of a display panel and a polarity distribution of data voltage thereon according to the second embodiment of the present invention.

FIG. 7 is a circuit diagram showing a color sub-pixel arrangement of a display panel and a polarity distribution of data voltage thereon according to the second embodiment of the present disclosure.

The data lines D1~Dm of the data driver 100 can be can be divided into a fixed number of data line groups. Each of the data line groups can include first through eighth data lines. One of data voltages on the first through fourth data lines can have one of negative (−) and positive (+) polarities and the other data voltages can have the other polarity. Alternatively, the data voltage of the first and fourth data lines can have one of the negative (−) and positive (+) polarities and the data voltages of the second and third data lines can have the other polarity. Also, the data voltages on the fifth through eighth data lines can have contrary polarities to those of the first through fourth data lines. For example, the data voltages on the first through eighth data lines Dj~Dj+7 can have polarities of "+, −, −, +, −, +, +, −" or "−, +, +, −, +, −, −, +" according to the rows, as shown in FIG. 7.

The polarities of the data voltages applied to the first through eighth data lines Dj~Dj+7 can be inverted every a single frame. Such a frame inversion inverting the polarity of the data voltage every a single frame can prevent the image quality defects which are caused by the polarization of liquid crystal.

For example, the data voltages having polarities of "+, −, −, +, −, +, +, −" in sequence can be written in color sub-pixels on a part of rows and the data voltages having polarities of "−, −, +, −, +, +, −, +" in sequence can be written, as shown in FIG. 4. To this end, the data voltage applied to the first data line Dj can have the positive polarity (+), the data voltage applied to the second data line Dj+1 can have the negative polarity (−), the data voltage applied to the third data line Dj+2 can have the negative polarity (−), and the data voltage applied to the fourth data line Dj+3 can have the positive polarity (+). Also, the data voltages applied to the fifth through eighth data lines Dj+4 through Dj+7 can have contrary polarities to the data voltages applied to the first through fourth data lines Dj through Dj+3. In detail, the data voltage applied to the fifth data line Dj+4 can have the negative polarity (−), the data voltage applied to the sixth data line Dj+5 can have the positive polarity (+), the data voltage applied to the seventh data line Dj+6 can have the positive polarity (+), and the data voltage applied to the eighth data line Dj+7 can have the negative polarity (−). As such, the data voltages maintaining one of the positive and negative polarities during a single frame period can be transferred through the data lines Dj~Dj+7. The polarities of the data voltages transferred through the data lines Dj~Dj+7 can be inverted in next frame.

In this manner, the data voltages with the same polarity can be applied the sub-pixels which are connected to the same data line and arranged in the zigzag shape. Also, the data voltages each maintaining the same polarity during a single frame period can be applied to the data lines. As such, power consumption with respect to the inversion mode can be reduced.

Figure 8:
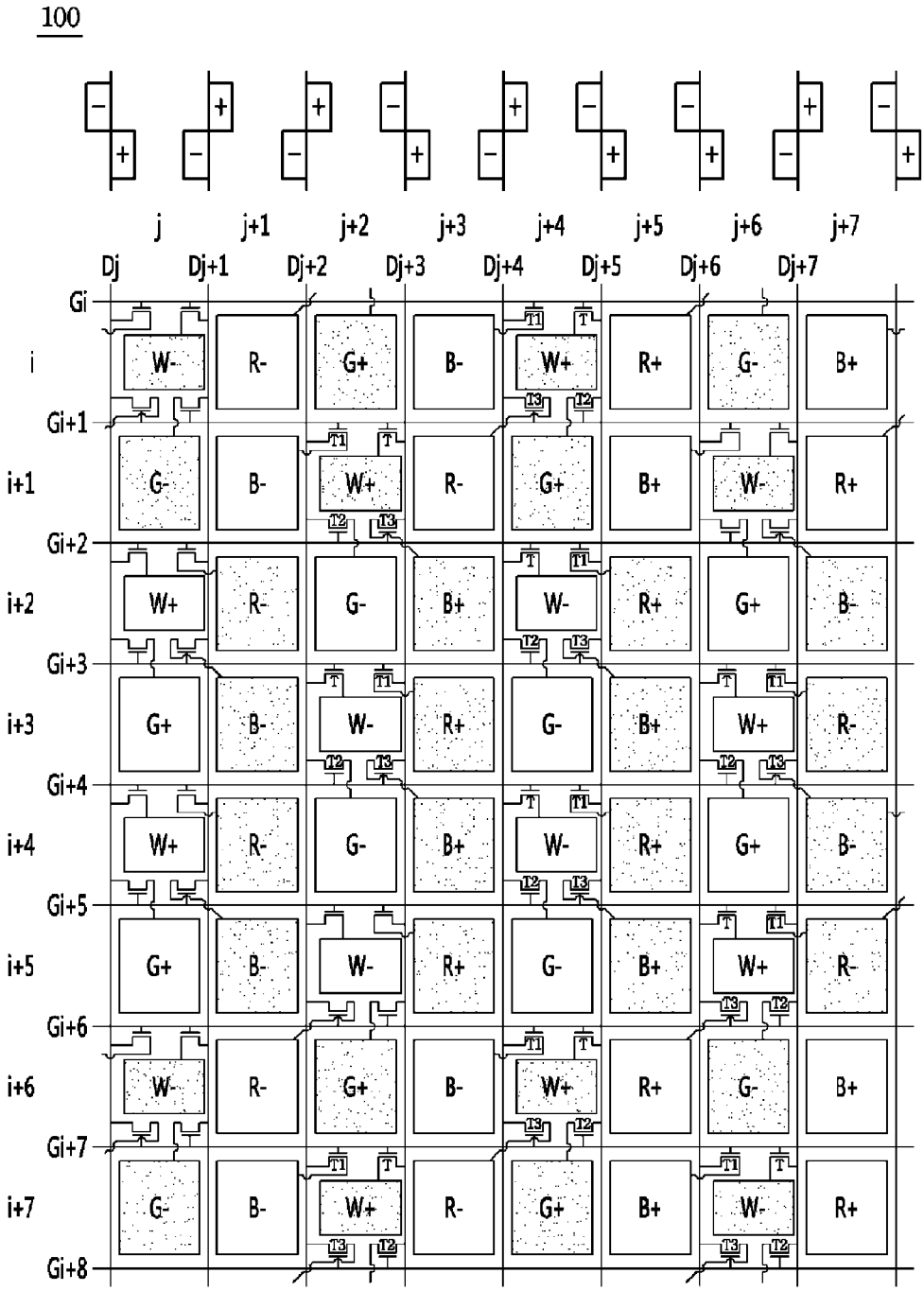
FIG. 8 is a circuit diagram showing a pixel arrangement of a display panel, which shares a single data line, and a polarity distribution thereon according to the second embodiment of the present invention.
Figure 9:
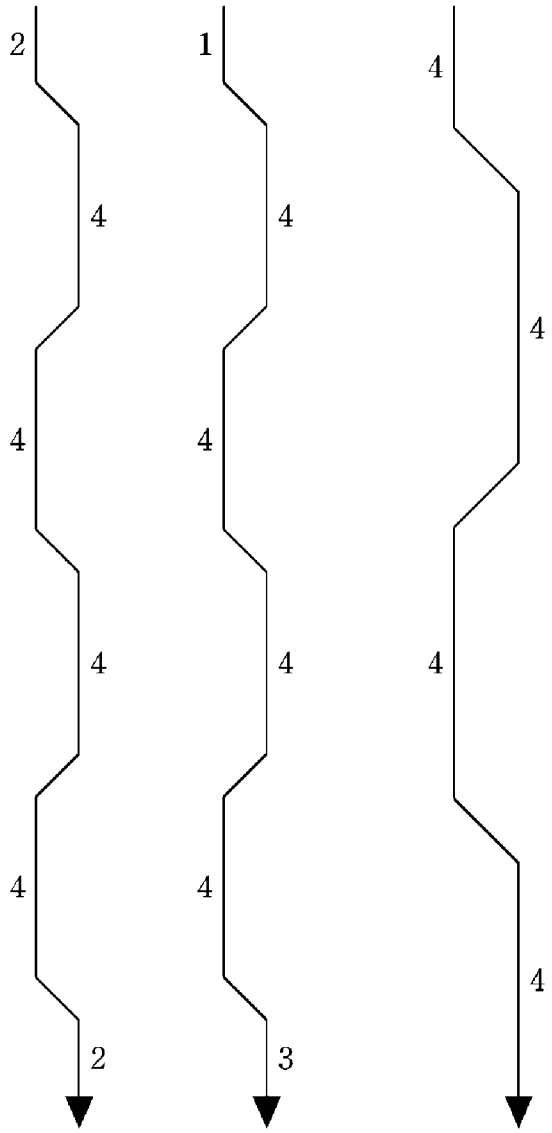
FIG. 9 is a graphic diagram showing a sub-pixel stream charged with the same polarity according to an embodiment of the present invention.

FIG. 8 is a circuit diagram showing a pixel arrangement of a display panel, which shares a single data line, and a polarity distribution thereon according to the second embodiment of the present disclosure. FIG. 9 is a graphic diagram showing sub-pixel stream charged with the same polarity according to an embodiment of the present disclosure.

As seen from FIGS. 8 and 9, it is evident that the sub-pixels charged with the same polarity are zigzagged along a vertical direction (i.e., a single data line) every four sub-pixels. If an even number of sub-pixels is arranged along a vertical direction, the sub-pixels charged with the same polarity can be disposed alternately left and right sides along a vertical axis in one of the sequences of "2, 4, 4, 4, . . . , 4, 4, 4, 2", "1, 4, 4, 4, . . . , 4, 4, 4, 3" and "4, 4, 4, 4, . . . , 4, 4, 4, 4" on the basis of the disposition of the first through fourth thin-film-transistor-inclusive sub-pixels 101, 102, 103 and 104. In the above-mentioned sub-pixel arrangement, the sub-pixels within the middle area of the display panel 100 with the exception of top and bottom edges can be arranged in the shape zigzagging along a vertical direction (or along a single data line) every four sub-pixels.

Such sub-pixel arrangement zigzagging every two sub-pixels can prevent (or minimize) arrangement of the same polarity, when a mono color is displayed on the display panel 100. Also, the polarity inversion being performed every frame can not only induce an inversion effect but also reduce power consumption.

Figure 10:
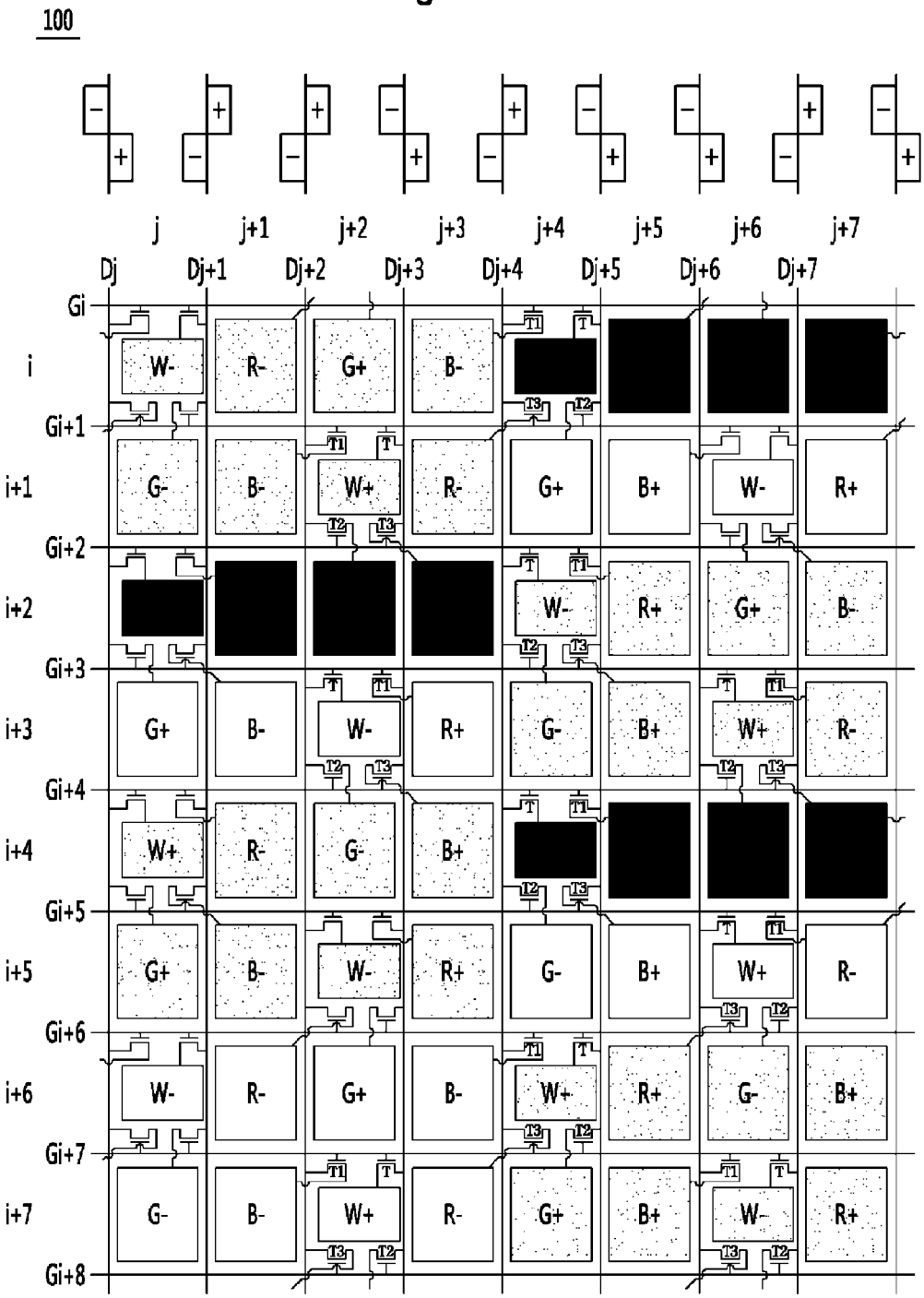
FIG. 10 is a circuit diagram showing a polarity distribution of the display panel according to the second embodiment of the present invention when a diagonal line pattern is displayed.

FIG. 10 is a circuit diagram showing a polarity distribution of the display panel according to the second embodiment of the present disclosure when a diagonal line pattern is displayed.

As seen from FIG. 10, it is evident that the same color sub-pixels charged with the same polarity are not disposed when a diagonal line pattern is displayed on the display panel 100. Also, the same polarity is developed in the shape of zigzagging alone the vertical direction every 4 sub-pixels. In accordance therewith, the generation of a flicker phenomenon in a fixed pattern, such as a horizontal line, a diagonal line or other, can be prevented.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents without being limited to the description of the present disclosure.

What is claimed is:

1. A display panel comprising:

a plurality of gate lines and a plurality of data lines disposed to cross each other and define a plurality of sub-pixel regions; and a plurality of sub-pixels disposed in the plurality of sub-pixel regions and configured to share one of the data lines adjacent thereto, wherein the sub-pixels sharing the same data line are arranged in a shape of zigzagging along a vertical direction by four sub-pixels, wherein each sub-pixel region among the plurality of sub-pixel regions includes a thin-film-transistor-inclusive sub-pixel region connected to pixel electrodes in first, second and third sub-pixels adjacent to the thin-film-transistor-inclusive sub-pixel region, wherein the thin-film-transistor-inclusive sub-pixel region includes thin film transistors connected to the first, second and third sub-pixels, respectively, and wherein the thin film transistors include:

a first thin film transistor connected to a first pixel electrode disposed on the first sub-pixel region;

a second thin film transistor connected to a second pixel electrode disposed on the second sub-pixel; and a third thin film transistor connected to a third pixel electrode disposed on the third sub-pixel region, and wherein the first sub-pixel region is adjacent to the thin-film-transistor-inclusive sub-pixel region and disposed along a first direction directed away from the thin-film-transistor-inclusive sub-pixel region, the second sub-pixel region is adjacent to the thin-film-transistor-inclusive sub-pixel region and disposed along a second direction that is perpendicular to the first direction and directed away from the thin-film-transistor-inclusive sub-pixel region, and the third sub-pixel region is adjacent to the second sub-pixel region and disposed along a third direction that is opposite to the first direction and directed away from the second sub-pixel region.

2. The display panel of claim 1, wherein the plurality of sub-pixels includes sub-pixels configured to display red, green, blue and white colors.

3. The display panel of claim 2, wherein the plurality of data lines is divided into plural groups, each of the groups including first through fourth data lines used to transfer data voltages with polarities corresponding to one of "+,−,−,+" and "−,+,+,−" and fifth through eighth data lines used to transfer the data voltages with contrary polarities to those of the data voltage on the first through fourth data lines.

4. The display panel of claim 3, wherein the data voltages are inverted in polarity every frame.

5. The display panel of claim 1, wherein the sub-pixel disposed in the thin-film-transistor-inclusive sub-pixel region is used to display a white color.

6. The display panel of claim 5, wherein the thin-film-transistor-inclusive sub- pixel region includes a smaller sized pixel electrode compared to the pixel electrodes which are disposed on the sub-pixel regions adjacent thereto.

7. The display panel of claim 6, wherein the thin-film-transistor-inclusive sub-pixel region further includes a fourth transistor which is connected to the pixel electrode disposed in the thin-film-transistor-inclusive sub-pixel region.

8. A display panel comprising:

a plurality of gate lines and a plurality of data lines disposed to cross each other and define a plurality of sub-pixel regions; and a plurality of sub-pixels disposed in the plurality of sub-pixel regions, wherein the plurality of sub-pixel regions includes thin-film-transistor-inclusive sub-pixel regions, wherein each thin-film-transistor inclusive sub-pixel region among the thin-film-transistor-inclusive sub-pixel regions includes thin film transistors respectively connected to pixel electrodes of sub-pixels adjacent to the corresponding thin-film-transistor-inclusive sub-pixel region and a smaller sized pixel electrode having a smaller size than the pixel electrodes of the sub-pixels adjacent to the corresponding thin-film-transistor-inclusive sub-pixel region, and wherein the smaller sized pixel electrode of the corresponding thin-film-transistor-inclusive sub-pixel region is spaced apart from the thin film transistors respectively connected to the pixel electrodes of the sub-pixels adjacent to the corresponding thin-film-transistor-inclusive sub-pixel region.

9. The display panel of claim 8, wherein the sub-pixel disposed in the thin-film-transistor-inclusive sub-pixel region is used to display a white color.

10. The display panel of claim 9, wherein the thin film transistors include:

a first thin film transistor connected to the pixel electrode which is disposed on the sub pixel region adjacent to one of left and right edges of the thin-film-transistor-inclusive sub-pixel region;

a second thin film transistor connected to the pixel electrode which is disposed on the sub-pixel adjacent to a bottom edge of the thin-film-transistor-inclusive sub-pixel region; and a third thin film transistor connected to the pixel electrode which is disposed on the sub-pixel region adjacent to the thin-film-transistor-inclusive sub-pixel region in one of downward diagonal directions.

11. The display panel of claim 10, wherein the thin film transistors further include a fourth transistor which is connected to the pixel electrode disposed in the thin-film-transistor-inclusive sub-pixel region.

12. The display panel of claim 8, wherein the plurality of sub-pixels includes:

first sub-pixels configured to each display a first color;

second sub-pixels configured to each display a second color;

third sub-pixels configured to each display a third color; and fourth sub-pixels configured to each display a fourth color.

13. The display panel of claim 12, wherein the sub-pixels configured to display the same color are arranged to be separate from one another.

14. The display panel of claim 12, wherein the first through fourth sub-pixels share a single data line or a same data line, and are arranged in a shape of zigzagging along a vertical direction by twos.

15. The display panel of claim 8, wherein the plurality of data lines is divided into plural groups, each of the groups including first through fourth data lines used to transfer data voltages with polarities corresponding to one of "+,−,−,+" and "−,+,+,−" and fifth through eighth data lines used to transfer the data voltages with contrary polarities to those of the data voltage on the first through fourth data lines.

16. The display panel of claim 15, wherein the data voltages are inverted in polarity every frame.

* * * * *